United States Patent [19]

Reznik

[11] 4,421,781

[45] Dec. 20, 1983

[54] CONTINUOUS VACUUM CURING AND SOLVENT RECOVERY COATING PROCESS

[75] Inventor: David Reznik, Haifa, Israel

[73] Assignee: Tri/Valley Growers, San Francisco, Calif.

[21] Appl. No.: 362,628

[22] Filed: Mar. 29, 1982

[51] Int. Cl.[3] ..... B05D 3/02; B05D 1/40; B05D 3/12; C23C 13/08

[52] U.S. Cl. ..... 427/46; 118/50.1; 118/642; 118/643; 427/345; 427/350; 427/379; 427/388.1

[58] Field of Search ..... 427/45.1, 46, 294, 295, 427/350, 345, 379, 388.1; 118/50, 50.1, 642, 643

[56] References Cited

U.S. PATENT DOCUMENTS

| | | | |
|---|---|---|---|
| 1,997,761 | 4/1935 | Bailey et al. | 427/46 |
| 3,551,189 | 12/1970 | Gray et al. | 427/345 |
| 4,050,412 | 9/1977 | Bautz | 118/642 |

*Primary Examiner*—Michael R. Lusignan
*Attorney, Agent, or Firm*—Edward B. Gregg; Willis E. Higgins

[57] ABSTRACT

An apparatus (10) for applying polymerized coatings to can bodies (12) has a means (13) for applying the coating as a liquid containing a polymerizable or polymer coating material in one or more vacuum liquifiable solvents. The coated can bodies (12) are heated in a confined space (22) a sufficient extent by induction coils (20) to substantially exclude air at entrance (16) to vacuum chamber (18). Second induction coils (28) heat the can bodies (12) further to flash evaporate the remaining vacuum condensable solvent from the coatings and to cure the coatings. The solvent vapor is condensed in the vacuum chamber (18) and condensers (68, 72, 76). A means (50) supplies a sufficient quantity of water at exit (42) from the vacuum chamber (18) to substantially exclude air at the exit (42). The can bodies (12) vaporize the water and the water vapor excludes the air. The water vapor is condensed under the vacuum of the chamber (18) by condenser (52). Because only the vacuum condensable solvent vapor is introduced to the vacuum chamber (18) at entrance 16 and only the water vapor is introduced to the vacuum chamber (18) at the exit (42), and both vapors are condensed in the vacuum, only a small vacuum pump (50) is required to maintain the vacuum in the chamber (18), and the pump is operated only when the vacuum decreases. Curing the coatings under vacuum makes them very high quality over a wide thickness range.

24 Claims, 4 Drawing Figures

CONTINUOUS VACUUM CURING AND SOLVENT RECOVERY COATING PROCESS

BACKGROUND OF THE INVENTION

1. Field of the Invention

This invention relates to an improved apparatus and process for fabricating a coated substrate with a cured, polymerized coating. More particularly, it relates to an apparatus and process in which a coating of polymerizable or polymeric material is applied to the substrate in a vacuum liquifiable solvent, and the solvent is evaporated and recovered in an improved manner. Most especially, the invention relates to an apparatus and process for applying lacquer or enamel coatings to a tinplate substrate.

2. Description of the Prior Art

It has long been conventional practice to coat the inside of cans formed from tinplated metal used for food and other packaging with a lacquer or enamel in order to prevent corrosion of the cans from the food product and contamination of the food product. As typically practiced, such lacquer or enamel coatings are roll applied in a solvent to flat stock used to make the can bodies, the solvent is evaporated in air in a heated oven, and the flat stock is further heated to cure the lacquer or enamel. As concerns over environmental pollution from such solvents have increased, the practice of incinerating the evaporated solvent has begun. Solvent recovery has not proved to be practical in such processes, because the concentration of solvent in the air from such ovens is kept below about 0.5 percent by weight, in order to avoid creating explosive After the coating of the flat tinplate stock has been carried out in this manner, the can bodies are formed, sealed along the seam, flanged for attachment of a top and bottom, and beaded to increase their strength. These operations produce scratches and other visible damage to the lacquer or enamel coatings. Additionally, such mechanical stresses applied to the coatings weaken them in ways that are not readily detectable by visual observation, such as by stretching the polymers which form the coatings. The resulting loss of integrity of the coatings results in accelerated deterioration of the cans after they have been filled and causes undesirable contamination, particularly in the case of beverages, the flavor of which is very sensitive to minute amounts of impurities.

It has generally not proved to be economical to coat the interior of the can bodies after the mechanical forming and seam soldering or welding processes have been completed in such air oven heating processes because of the much higher oven volume occupied by formed can bodies as compared with flat metal stock. However, a second layer of lacquer or enamel is often applied at the can seam, but only partially cured, as a way of increasing the integrity of the coating inside the finished can. Some seamed beer cans have a second vinyl coating applied after formation of the can body because beer is especially sensitive to flavor alteration by contaminants, but such a second coating adds materially to the cost of the cans.

The use of air ovens for solvent evaporation and the curing of the coatings further introduces problems in coating integrity from cratering and trapped air or other gas around can seams. This is especially true if the thickness of the cured coating is not carefully controlled and kept thin.

In recent years, as energy costs have escalated rapidly, there has been a demand for a more energy-efficient, non-polluting process for providing such coatings on tinplate cans and similar substrates. There is further a desire to increase coating integrity, especially at different thicknesses.

My issued Israeli Patent based on Application No. 50398, filed Sept. 1, 1976, discloses vacuum treatment apparatus in which a vacuum condensable gas is provided to exclude air at the entrance and exit of a vacuum chamber in which materials are subjected to various treatment processes. The vacuum condensable gas is provided separately from the materials being treated in the vacuum chamber.

SUMMARY OF THE INVENTION

Accordingly, it is an object of this invention to provide an energy-efficient and pollution-free process for application of a solvent based polymer coating to a substrate and subsequent curing of the coating.

It is another object of the invention to provide a tinplate polymer coating process and apparatus utilizing less energy and producing less volatile solvent pollution than prior art tinplate polymer coating processes.

It is a further object of the invention to provide such a process and apparatus in which the solvent for the polymer coating is recovered for re-use.

It is still another object of the invention to provide a process for coating can interiors after formation which is economically feasible in comparison with the use of air heated ovens with flat can stock.

It is yet another object of the invention to provide a process for applying a polymer coating to a substrate in a solvent, evaporating the solvent and curing the coating, which will provide a coating of increased integrity over a greater range of coating thicknesses.

The attainment of the foregoing and related objects may be achieved through use of the novel coating apparatus and process herein disclosed. The novel apparatus for coating a substrate of this invention includes a vacuum chamber having an entrance and exit for the substrate to be coated. A means is provided for applying a coating of a polymerizable material or a polymer in a vacuum liquifiable solvent to the substrate. There is a means defining a confined space around the entrance to the vacuum chamber. A first means for heating the substrate in the confined space evaporates sufficient solvent for the substantial exclusion of air around the entrance to the vacuum chamber. There is a means at the entrance of the vacuum chamber for moving the coated substrate and evaporated solvent from the confined space into the vacuum chamber. The vacuum chamber incorporates a means for liquifying the vacuum liquifiable solvent while in the vacuum of the vacuum chamber. A means at the exit of the vacuum chamber removes the coated substrate from the vacuum chamber. A single opening may be used for both moving the substrate into and out of the vacuum structure. As will be explained in more detail below, the means for moving the substrate into the vacuum chamber and the means for removing the substrate may be combined in a single structure in such case. A second heating means heats the coated substrate to flash evaporate remaining solvent from the coating in the vacuum chamber and to cure the coating. In particular, it is preferred to use induction heating coils for the two heating means when the substrate is metal.

In use of the apparatus of this invention, the novel coating process of this invention includes the steps of applying a coating of a polymerizable material in a vacuum liquifiable solvent to the substrate. The substrate is heated in the confined space around the entrance to the vacuum chamber to evaporate a sufficient amount of the solvent for the substantial exclusion of air around the entrance to the vacuum chamber, i.e., an amount at least about equal to a vapor pressure of one atmosphere. The coated substrate and evaporated vacuum condensable solvent are admitted to the vacuum chamber, with the substantial exclusion of air. The solvent is liquified while subject to the chamber vacuum, and the substrate is heated a second time to cure the polymerizable material, preferably also while in the vacuum. In addition to promoting solvent removal, the vacuum promotes better integrity of the cured coating at widely varying thicknesses.

While the apparatus and process of this invention are especially suited for coating steel or tinplate metal cans with lacquer or enamel, they should find application for coating a wide variety of materials on a wide variety of other substrates as well. Because substantially only the evaporated, vacuum liquifiable solvent is admitted to the vacuum chamber along with the coated substrate, and the liquifiable solvent is liquified in the vacuum chamber, a small vacuum pump is sufficient for maintaining the vacuum in the vacuum chamber, and will typically only need to be operated intermittently to maintain the vacuum.

The attainment of the foregoing and related objects, advantages and features of the invention should be more readily apparent to those skilled in the art after review of the following more detailed description of the invention, taken together with the drawings, in which:

DETAILED DESCRIPTION OF THE INVENTION

Figure 1:
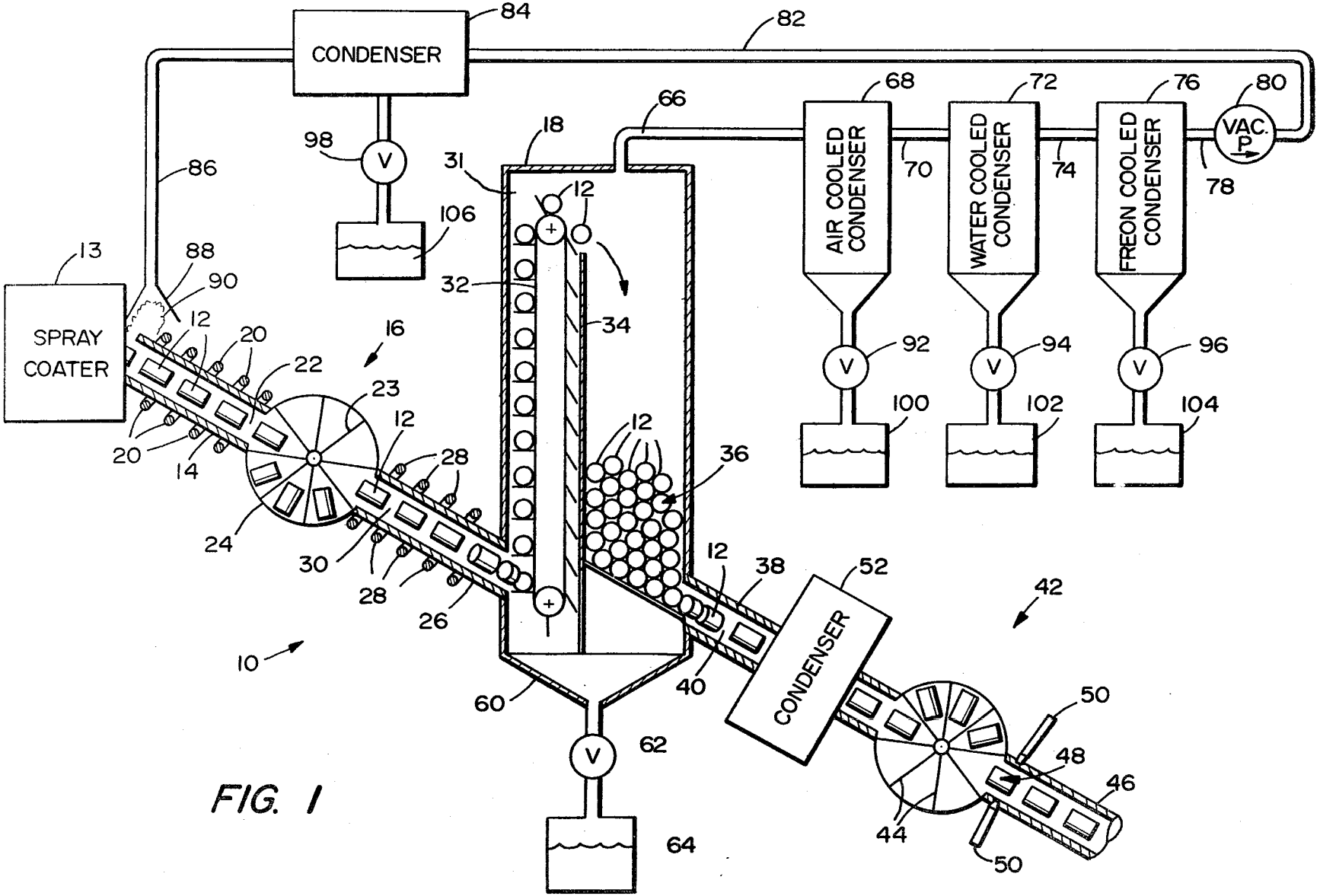
FIG. 1 is a schematic view of apparatus for 30 carrying out the process of this invention.

Turning now to the drawings, more particularly to FIG. 1, there is shown an apparatus 10 for applying enamel or lacquer coatings to the interior of tinplate or steel can bodies 12. The cylindrical can bodies 12 are fabricated by any conventional process, i.e., they may be drawn, soldered or welded. A lacquer, enamel, or other suitable coating is spray applied in solution with a vacuum liquifiable solvent in a spray coater 13 of conventional design. Since the design of the spray coater 13 does not constitute a part of this invention and such coaters are commercially available, it will not be described in further detail. Glass pipe 14 supplies the can bodies 12 to feed through mechanism 16 of vacuum chamber 18. Glass pipe 14 forms a confined space 22 around the feed through mechanism 16 to vacuum chamber 18. A series of induction coils 20 are provided around glass pipe 14 for heating the can bodies 12 to evaporate enough solvent from the coating on the interior of the can bodies to exclude air at the feed through mechanism 16. A solvent vapor pressure of at least one atmosphere will totally exclude air at this point. With a methyl ethyl ketone solvent, a can body 12 temperature of about 150° C. is sufficient.

Feedthrough mechanism 16 to vacuum chamber 18 incorporates revolving partitions 23 in housing 24, which define receptacles for each of the can bodies 12. The can bodies 12 are deposited from mechanism 16 into a second glass pipe 26, connected to the vacuum chamber 18. A second series of induction coils 28 is also provided around pipe 26 for further heating of the can bodies 12. The can bodies 12 enter the second glass pipe 26 at a temperature of about 150° C. as a result of the heating by the first set of induction coils 20 around first glass pipe 14. Since the inside 30 of second glass pipe 26 is at the vacuum of chamber 18, the remaining solvent in the coatings on the inside of the can bodies 12 is rapidly flash evaporated. In a typical situation in which roughly half of the solvent in the coatings is evaporated in first glass pipe 14, and the remaining half of the solvent is flash evaporated in the second glass pipe 26, the heat of vaporization of the solvent in the second glass pipe 26 will reduce the temperature of the can bodies 12 by about 40° to 50° C. The second set of induction coils 28 heats the can bodies 12 to a temperature of about 210° C., in order to allow the coatings on the inside of the can bodies 12 to be thermally cured.

From the second glass pipe 26, the can bodies 12 move by gravity into the main portion 31 of the vacuum chamber 18, where they enter an endless belt conveyer 32. The can bodies are raised by the endless belt conveyer 32 over partition 34, where they accumulate in a space 36 formed by the partition 34 and the side walls of the vacuum chamber 18. Since a vacuum of approximately 700 mm Hg is maintained in the vacuum chamber 18, very little heat loss by convection by the can bodies 12 occurs in the vacuum chamber 18. The space 36 in which the can bodies 12 accumulate is provided in order to allow an increased residence time for the can bodies 12 in the vacuum chamber 18, so that the curing of their interior coatings will go to substantial completion before the can bodies pass out of the main body 31 of the vacuum chamber 18 to a third glass pipe 38, the interior 40 of which is also at the vacuum of chamber 18. A residence time in the vacuum chamber of from about 2 to about 4 minutes at a temperature between about 200° and 210° C. is generally sufficient for most coatings. The third glass pipe 38 is connected to a second feedthrough mechanism 42 having the same construction as the feedthrough mechanism 16. Because the third glass pipe, like the first and second glass pipes 14 and 26, is inclined, the can bodies 12 enter the feedthrough mechanism 42 by gravity and are rotated by partitions 44 to exit enclosure 46 of the apparatus 10, which has an opening 48 facing the feedthrough mechanism 42 to receive the can bodies 12, again by gravity feed.

Air is prevented from entering the vacuum chamber 18 through the feedthrough mechanism 42 in a similar manner as with feedthrough mechanism 16. However, since the solvent in the coatings applied to the can bodies 12 has already been evaporated from the can bodies 12 at this point, it is necessary to provide a vacuum liquifiable vapor separately at the exit enclosure 46 for this purpose. It is preferred to use distilled water for this purpose, applied by atomizer spray nozzles 50 to the exterior of the can bodies 12. Since the can bodies 12 will be at a temperature only slightly below 200° to 210° C. as they leave the feedthrough mechanism 42, they will vaporize the distilled water to provide a water vapor pressure at least equal to one atmosphere, thus excluding air from the end of exit enclosure 46 facing the feedthrough mechanism 42. As a result of vaporizing the atomized distilled water, the temperature of the can bodies 12 is reduced to about 100° C. A condenser 52 is provided on the other side of the feedthrough mechanism 42 in order to condense the water vapor passing through mechanism 42 toward the vacuum chamber 18 as the can bodies 12 are moved to the exit chamber 46. The condenser 52 prevents the water vapor from entering the main portion 30 of the vacuum chamber 18.

The solvents used in typical commercially available coating compositions are a mixture of light and heavy fractions, and multi-stage condensing is desirably practiced in order to collect separate fractions. Since the main portion 31 of the vacuum chamber 18 is at a lower temperature than the 210° C. used to flash evaporate the solvent from the can bodies 10 in second glass pipe 26, at least a portion of the heaviest solvent fraction condenses in the main portion 31. Bottom 60 of the main portion 31 is shaped to collect the condensed portion of this fraction, which is supplied through valve 62 to receptacle 64.

Pipe 66 connects the main portion 31 of vacuum chamber 18 to an air cooled condenser 68 for condensing an additional heavier fraction of the coating solvent. Air cooled condenser 68 is connected by pipe 70 to a water cooled condenser 72 for condensing a lighter fraction. Water cooled condenser 72 is connected by pipe 74 to a Freon cooled condenser 76, for condensing the lightest fraction of the coating solvent, which consists primarily of methyl ethyl ketone. Pipe 78 connects the condensers 68, 72 and 76, and the vacuum chamber 18 to a vacuum pump 80. Pipe 82 connects the exit of vacuum pump 80 to a fourth condenser 84 for condensing any slight remaining quantities of coating solvent which are not condensed by the Freon cooled condenser 76. Pipe 86 also connects hood 88 to the condenser 84. Hood 88 collects a vapor plume 90 of the coating solvent at the entrance end to glass pipe 14. Providing a sufficient quantity of the coating solvent in the glass pipe 14 to produce the plume 90 will insure that air does not enter through feedthrough mechanism 16 with the can bodies 12. Suitable valves 92, 94, 96, and 98, and receptacles 100, 102, 104, and 106 are provided for each of the condensers 68, 72, 76 and 84.

The apparatus and process of this invention may be used for the application of a wide variety of solvent-thinned coatings on a wide variety of substrates. The essential limitation is that the solvent in each case produce a vacuum liquifiable vapor. It is preferred that the liquification be by condensation, although it could also occur, for example, by dissolving the vapor in another liquid inside the vacuum chamber. A wide variety of polar and non-polar inorganic and organic solvents meet this requirement. Suitable specific examples include water, benzene, petroleum-based solvents, ethylene trichloride, acetone, ether, methyl ethyl ketone, toluene, ethylene glycol, butylene glycol and the like. Similarly, a wide variety of polymerizable coating materials may be used, usually those of a thermo-setting type. Suitable specific examples of such resins include shellac, cellulose derivatives, such as nitro-cellulose-based lacquers, rubber derivatives, acrylic resins, vinyl resins, bitumens, epoxy, urethane, polyester resins, enamels, and the like. For use in coating tinplate cans, lacquer or enamel dissolved in a mixture of relatively high and low boiling point solvents is usually employed. These solutions are typically provided as about 20 weight percent resin in about 80 weight percent of the solvent. In the usual practice of the invention, a total quantity of from about 0.5 to about 1 g of solvent will be evaporated from each can body 12 of about 500 g capacity.

The preferred solvent for use in the apparatus and process of this invention is methyl ethyl ketone or a similar high vapor pressure solvent. The preferred coating composition for use in the apparatus and process is an epoxy-phenolic enamel, which is commercially available from a variety of sources. Such epoxy-phenolic enamels are ordinarily supplied as a 30 to 40 weight percent solids composition in a mixed high and low boiling point solvent, with the high boiling point solvent being present to assure uniform spreading of the coating. In the preferred practice of the process, such commercially available compositions are diluted at about 1:1 volume basis with methyl ethyl ketone to give from about 15 weight percent to about 20 weight percent of the resin and about 80 to about 85 weight percent of the resulting solvent mixture.

Figure 2:
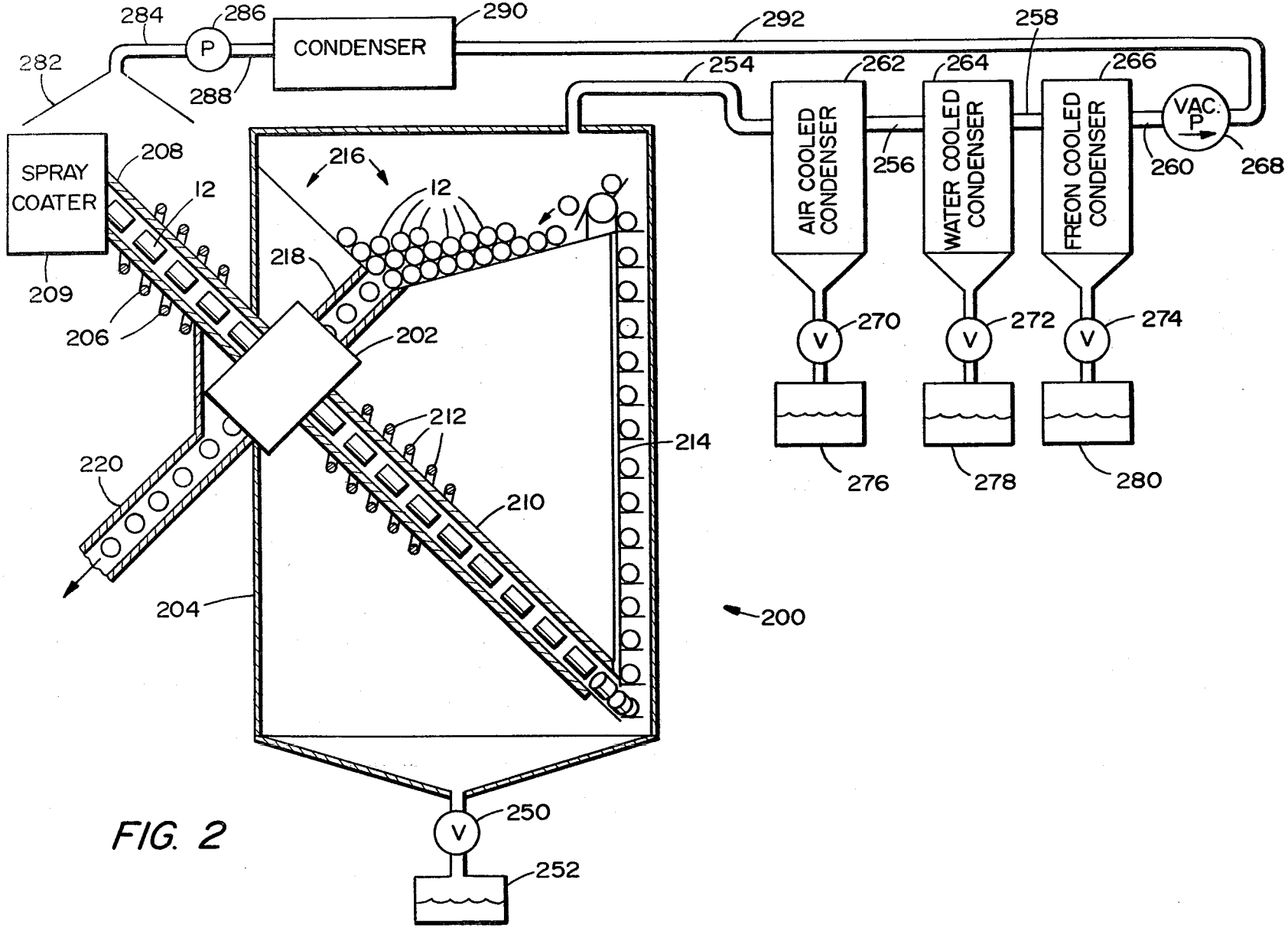
FIG. 2 is a schematic view of another embodiment of apparatus for carrying out the process of this invention.

FIG. 2 is another schematic diagram of another form of an apparatus 200 for practicing the process of this invention, in which a single feedthrough mechanism 202 may be employed both for introducing and removing the can bodies 12 from vacuum chamber 204. As in the case of the FIG. 1 embodiment, induction coils 206 are provided around a first glass pipe 208 for the purpose of heating the can bodies 12 to a temperature of about 150° C. prior to entering the feedthrough 202. A vapor pressure of solvent from the coating applied to the can bodies 12 in a spray coater (209) slightly in excess of one atmosphere is created within the glass tube 208, thus excluding air at the entrance to the feedthrough 202. The can bodies 12 and a quantity of the vaporized solvent enter vacuum chamber 204 through the feedthrough 202. The can bodies are further heated to a temperature of about 210° C. in glass pipe 210 by induction coils 212. The remaining solvent in the coatings on the can bodies 12 is rapidly flash evaporated in the vacuum of chamber 204, and curing of the coatings takes place while the can bodies 12 are resident in the vacuum chamber 204. Endless belt conveyer 214 receives the can bodies 12 from the end of glass pipe 210, which transports them to can reservoir 216 at the top of the vacuum chamber 204. Pipe 218 feeds the can bodies 12 to feedthrough 202 for removing them from vacuum chamber 204. From feedthrough 202, the can bodies 12 move to exit pipe 220 by gravity flow. In this embodiment, an enclosed chamber 222 connects the first glass pipe 208 and the exit pipe 220. The solvent vapor generated by heating the can bodies 12 in pipe 208 also fills chamber 222 and pipe 220, at least around the feedthrough 202. Air is therefore prevented from entering the vacuum chamber 204 through pipe 220 as well as through pipe 208 by the solvent vapor evaporated from the can bodies 12 in pipe 208. Exit pipe 220 may be glass as well in order to allow observation of the can bodies 12 leaving feedthrough 202, although this is not necessary unless induction coils are provided around the pipe 220 for further heating to assure complete curing of the coatings on can bodies 12.

Figure 3:
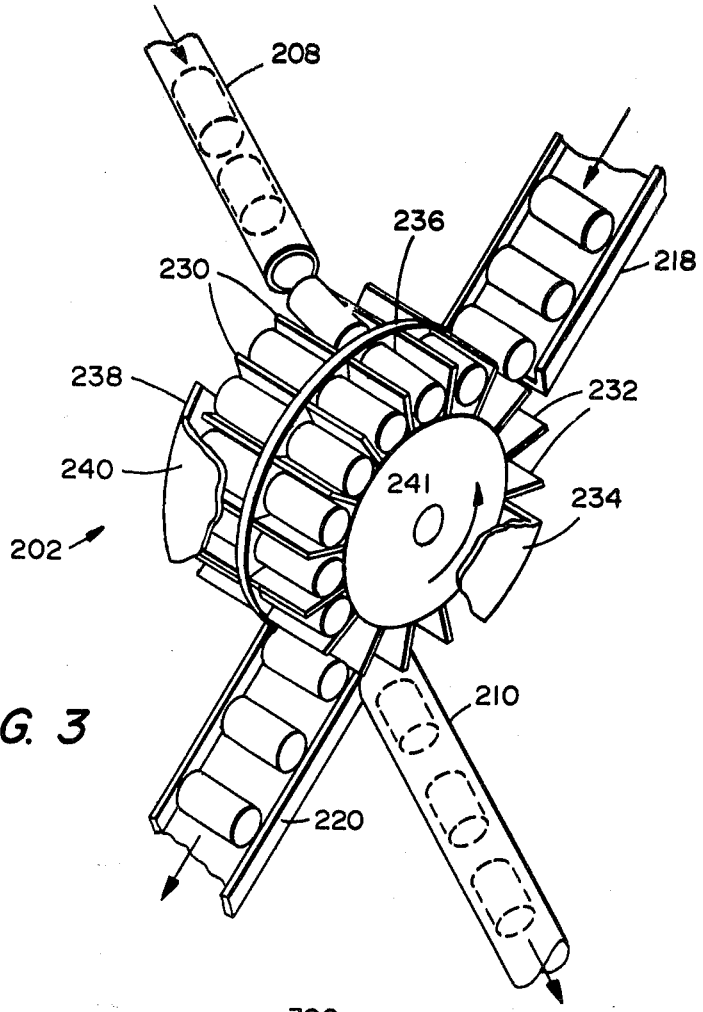
FIG. 3 is a perspective view showing a portion of the apparatus in FIG. 2.

FIG. 3 shows the construction of the feedthrough mechanism 202 which enables it to feed the can bodies 12 into the vacuum chamber 204 as well as feed them back out of the chamber 204. As shown, there are two sets of partitions 230 and 232 in superimposed relationship to form entrance and exit enclosures for the can bodies 12. The glass pipes 208 and 210 are positioned to register with the first set of enclosures formed by the partitions 230. The pipes 218 and 220 are positioned to register with the second set of enclosures formed by partitions 232. Since an equal number of enclosures for the can bodies 12 are formed by the partitions 230 and 232, rotation of the structure formed by the partitions 230, 232, side 234, plate 236 and side 238 of housing 240 around axis 241 feeds an equal number of can bodies 12 into and out of the vacuum chamber 204, assuming that a can body 12 is present at both glass pipe 208 and pipe 218 for each of the corresponding enclosures presented at these pipes for receiving the can bodies 12. The apparatus 200 may be operated to pass the can bodies 12 through the vacuum chamber 204 at a rate of, for example, 500 cans per hour, with a residence time in the vacuum chamber 204 of between 2 and 4 minutes.

As in the case of the FIG. 1 embodiment, the apparatus 200 of FIG. 2 has a valve 250 and receptacle 252 at the bottom of vacuum chamber 204 to receive an initial heavy fraction of the solvents from the coatings of the can bodies 12, which condenses in the vacuum chamber 204. Pipes 254, 256, 258, and 260 interconnect vacuum chamber 204 with air cooled condenser 262, water cooled condenser 264, Freon cooled condenser 266, and vacuum pump 268. Valves 270, 272 and 274 connect the condensers 262, 264, and 266 to solvent fraction receptacles 276, 278 and 280, respectively. Hood 282 and pipe 284 are connected through pump 286 and pipe 288 to condenser 290. The exit of vacuum pump 268 is connected by line 292 to condenser 290 as well. In other respects than as explained above, the operation of the FIG. 2 embodiment is the same as the FIG. 1 embodiment.

Figure 4:
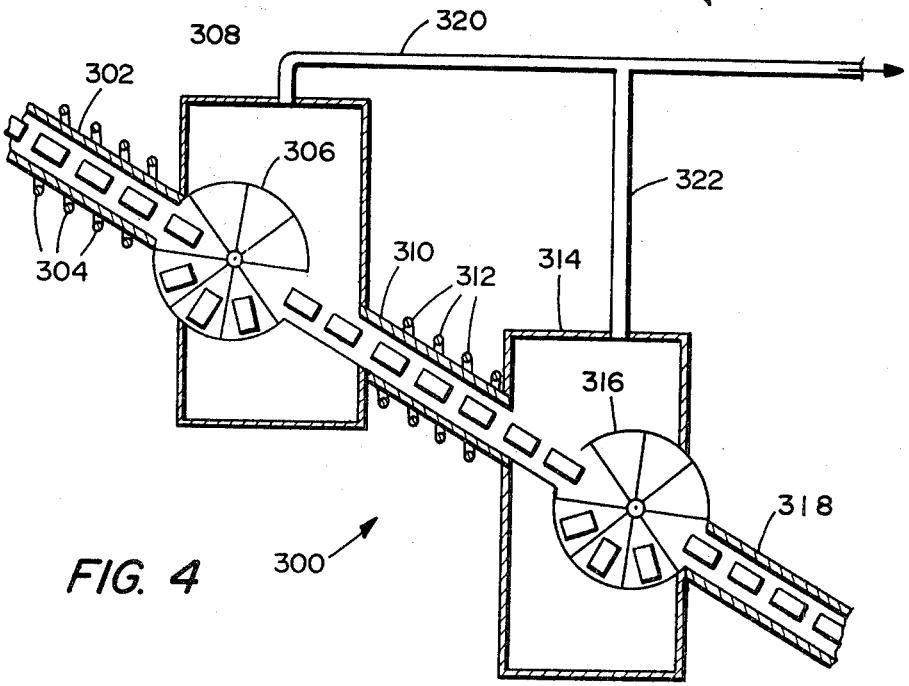
FIG. 4 is a schematic diagram of another embodiment of apparatus for carrying out the process of this invention.

FIG. 4 shows another apparatus 300 in accordance with the invention for use in practicing the process of the invention. The apparatus 300 has an inlet glass pipe 302 with induction coils 304 for preheating spray coated can bodies 12 to about 150° C., to vaporize solvent from the coatings to a vapor pressure of at least one atmosphere. A feedthrough mechanism 306 connects the glass pipe 302 to a first vacuum chamber 308, in which flash evaporation of the remaining solvent in the coatings on can bodies 12 takes place. A second glass pipe 310 with induction coils 312 is used to heat the can bodies 12 to the curing temperature of 210° C. A second vacuum chamber 314 is connected to the second glass pipe 310, and includes a conveyer and reservoir as in the FIG. 1 or FIG. 2 embodiment, in order to give a residence time under vacuum between 200° and 210° C. of from two to four minutes for the can bodies. A feedthrough mechanism 316 and exit pipe 318 are connected to receive the can bodies 12 from the second vacuum chamber 314. As in the FIG. 1 embodiment, a distilled water atomized spray is vaporized by the can bodies 12 to prevent the introduction of air through the feedthrough mechanism 316. A separate condenser (not shown) for the resulting water vapor is provided in order to prevent contamination of the solvents with water. Pipes 320 and 322 connect the vacuum chambers 308 and 314 to multi-stage condensers as in the FIGS. 1 and 2 embodiments for liquifying and collecting the solvent vapor. The pipes 302, 310 and 318 in the FIG. 4 embodiment may be inclined so that the can bodies 12 move by gravity within the apparatus 300, or endless belt conveyers may be employed for moving the can bodies.

The following non-limiting examples represent best modes contemplated by the inventor for practicing the invention and describe the invention further.

EXAMPLE 1

In order to prove the feasibility of the basic process conditions employed in the practice of this invention, the following procedure is carried out on a batchwise basis in a vacuum chamber. A coating of an epoxy-phenolic enamel solution obtained from Polylac in Israel, under the designation number 374, is diluted on a 1:1 by volume basis with methyl ethyl ketone, to give a composition containing 18 percent by weight resin in 82 percent by weight mixed solvent, primarily methyl ethyl ketone. The resulting composition is spread on tinplate sheet stock. The sheet stock is placed in the vacuum chamber on a resistance heated plate, the vacuum chamber is sealed, the can bodies are heated to 120° C., and a vacuum of 700 mm Hg is pulled in the vacuum chamber. Solvent vapor flash evaporated from the can bodies is condensed in small, water cooled condensers connected to the vacuum chamber. The can bodies are heated to 210° C. in the vacuum chamber while under this vacuum and kept in the vacuum chamber at that temperature for two more minutes to cure the coating layers. The resulting cured coatings on the can bodies are crater- and bubble-free over a thickness variation by a factor of 10.

EXAMPLE 2

The procedure of Example 1 is repeated on can bodies with the coatings spray applied on their interior surface, but using a vacuum apparatus as shown in FIG. 1, with atomized distilled water applied to the can bodies to form steam at the exit from vacuum chamber 18. The resulting coatings on the can bodies have the same characteristics as observed in Example 1. A one horsepower vacuum pump, intermittently operated, is sufficient to maintain the vacuum at 700 mm Hg during the process, and essentially all of the solvent is recovered for re-use.

Similar advantageous results are obtained with other resins, other solvents, and other apparatus as described above.

It should now be apparent to those skilled in the art that a novel coating apparatus and process capable of achieving the stated objects of the invention has been provided. By utilizing a vacuum liquifiable solvent for the heat curable coating materials employed in the apparatus and process and evaporating a sufficient quantity of the solvent from the coatings after application at the entrance to substantially exclude air at the entrance and also providing the solvent vapor or another vacuum liquifiable vapor at the exit to the vacuum chamber, a highly efficient, pollution-free apparatus and process results, which produces superior quality coatings on substrates over a wide range of coating thicknesses.

It should further be apparent to those skilled in the art that various changes in form and details of the invention as shown and described may be made. For example, if desired, only the flash evaporation of the solvent from the coatings need be carried out under the vacuum. The subsequent curing of the coatings may then be carried out in air after the substrates have left the vacuum chamber. It is intended that such changes be included within the spirit and scope of the claims appended hereto.

What is claimed is:

1. A process for coating a substrate which comprises:
establishing a vacuum in a vacuum chamber,
applying a polymerizable coating material in a vacuum liquifiable solvent to the substrate,
heating the substrate in a confined space around an entrance to the vacuum chamber to evaporate a sufficient amount of the solvent for the substantial exclusion of air around the entrance to the vacuum chamber,
admitting the coated substrate and evaporated vacuum condensable solvent to the vacuum chamber to the substantial exclusion of air,
condensing the solvent while subject to the chamber vacuum, and
heating the substrate a second time to cure said polymerizable material.

2. The process of claim 1 in which the substrate is heated the second time in the vacuum chamber.

3. The process of claim 2 in which additional solvent is flash evaporated from the coating in the vacuum chamber.

4. The process of claim 1 in which the substrate is a metal can body.

5. The process of claim 4 in which the metal substrate is heated by induction.

6. The process of claim 1 in which the coating material in the condensable solvent is a polymerizable material or a polymer and is applied by spraying.

7. The process of claim 6 in which the polymerizable material is a lacquer or enamel.

8. The process of claim 6 in which the condensable solvent is methyl ethyl ketone.

9. Apparatus for coating a substrate, which comprises:
a vacuum chamber having an entrance and exit for the substrate,
means for applying a coating material in a vacuum liquifiable solvent to the substrate,
means defining a confined space around the entrance to said vacuum chamber,
first means for heating the substrate in the confined space to evaporate sufficient solvent for the substantial exclusion of air around the entrance to said vacuum chamber,
means at the entrance of said vacuum chamber for moving the coated substrate and evaporated solvent from the confined space into said vacuum chamber,
means for condensing said vacuum condensable solvent while in the vacuum of said vacuum chamber,
means at the exit of said vacuum chamber for removing the coated substrate from said vacuum chamber, and
second means for heating the coated substrate to cure the coating.

10. The apparatus of claim 9 in which the substrate is metal and said first and second heating means are induction coils.

11. The apparatus of claim 10 in which said confined space defining means is formed from an insulating material and is encircled by the induction coils of said first heating means.

12. The apparatus of claim 11 in which said confined space defining means is a glass pipe.

13. The apparatus of claim 10 in which the induction coils of said second heating means heat the substrate while the substrate is in the vacuum of the vacuum chamber.

14. The apparatus of claim 13 in which the induction coils of said second heating means are inside said vacuum chamber.

15. The apparatus of claim 13 in which the induction coils of said second heating means are outside said vacuum chamber and encircle an insulating enclosure for the metal substrate, the interior of the insulating enclosure being at the vacuum of said vacuum chamber.

16. The apparatus of claim 15 in which the insulating enclosure is a glass pipe.

17. The apparatus of claim 9 in which said coating applying means is a spray coater.

18. The apparatus of claim 9 in which said means for condensing comprises a vacuum condenser connected to said vacuum chamber and a vacuum pump connected to said vacuum condenser, the vacuum pump also establishing the vacuum in said vacuum chamber.

19. The apparatus of claim 9 additionally comprising means defining a confined space around the exit of said vacuum chamber and means for providing a sufficient amount of a vacuum liquifiable vapor in the confined space for the substantial exclusion of air around the exit of said vacuum chamber.

20. The apparatus of claim 19 in which said vacuum liquifiable vapor providing means comprises a spray nozzle for contacting the substrate with a liquid while the substrate is at an elevated temperature to produce the vacuum liquifiable vapor.

21. The apparatus of claim 20 in which the vacuum liquifiable vapor is steam.

22. The apparatus of claim 19 additionally comprising a vacuum condenser between the exit and the remainder of said vacuum chamber to exclude the vacuum liquifiable vapor entering said vacuum chamber from the exit from the remainder of said vacuum chamber.

23. The apparatus of claim 19 in which said means for moving the coated substrate and evaporated solvent into said vacuum chamber and said means for removing the coated substrate from the vacuum chamber comprise a plurality of partitions mounted for rotation in a housing at the entrance and exit for the substrate to and from said vacuum chamber.

24. The apparatus of claim 23 in which the entrance and exit for the substrate to and from said vacuum chamber are provided together and said means for providing a sufficient amount of the vacuum liquifiable vapor for the substantial exclusion of air around the exit of said vacuum chamber is said first means for heating the substrate to evaporate the vacuum liquifiable solvent at the entrance to said vacuum chamber.

* * * * *